US005568721A

United States Patent [19]

Alary et al.

[11] Patent Number: 5,568,721

[45] Date of Patent: Oct. 29, 1996

[54] SYSTEM FOR SUPPLYING FUEL TO AND COOLING A FUEL INJECTOR OF A DUAL HEAD COMBUSTION CHAMBER

[75] Inventors: Jean-Paul D. Alary, Saint Maur des Fosses; Michel A. A. Desaulty, Vert Saint Denis; Denis J. M. Sandelis, Nangis; Pierre M. V. E. Schroer, Brunoy, all of France

[73] Assignee: Societe Nationale d'Etude et de Construction de Moteurs d'Aviation S.N.E.C.M.A., Paris Cedex, France

[21] Appl. No.: 492,567

[22] Filed: Jun. 30, 1995

[30] Foreign Application Priority Data

Jun. 22, 1994 [FR] France ..... 94 07623

[51] Int. Cl.[6] ..... F02C 7/228

[52] U.S. Cl. ..... 60/39.03; 60/746

[58] Field of Search ..... 60/39.03, 39.33, 60/741, 742, 746, 747

[56] References Cited

U.S. PATENT DOCUMENTS 3,669,354 6/1972 Helyer .
4,305,255 12/1981 Davies et al. .

FOREIGN PATENT DOCUMENTS 2441725 11/1979 France .
1451416 9/1962 Germany .
WO94/08179 4/1994 WIPO .

*Primary Examiner*—Louis J. Casaregola
*Attorney, Agent, or Firm*—Bacon & Thomas

[57] ABSTRACT

The present invention relates to a method and apparatus for supplying fuel to and cooling a fuel injector of a gas turbine engine having a dual head combustion chamber. The method comprises the steps of supplying a total fuel flow to the fuel injector such that at least a portion of the total fuel flow circulates through the high power injector nozzle during all operational modes of the gas turbine engine, including those modes in which the high power injector is not supplying fuel to the combustion chamber, and evacuating unused fuel from the high power injector. The apparatus includes a fuel supply conduit connected to the high power injector to supply at least a portion of the total fuel flow supplied to the fuel injector to the high power injector during all operational modes of the gas turbine engine; a fuel control valve to control the amount of fuel flowing through the fuel injector orifices; and a fuel evacuation conduit connected to the high power injector so as to evacuate unused fuel from the high power injector.

9 Claims, 4 Drawing Sheets

SYSTEM FOR SUPPLYING FUEL TO AND COOLING A FUEL INJECTOR OF A DUAL HEAD COMBUSTION CHAMBER

BACKGROUND OF THE INVENTION

The present invention relates to a method and apparatus for supplying fuel to and cooling the high power or takeoff fuel injector of a gas turbine engine having a dual head combustion chamber.

Modern turbojet engines comprise dual head combustion chambers fed with fuel from a double injector comprising a first fuel supply for a low power fuel injector and a second fuel supply for the high power or takeoff fuel injector. The low power fuel injector of the dual head combustion chamber is permanently supplied with fuel regardless of the operational mode of the turbojet engine. On the other hand, the high power or takeoff fuel injector is supplied with fuel only beyond a minimum operating mode corresponding to approximately 20% of the maximum operational mode of the engine. Accordingly, when the engine is operating in a low power mode, the high power or takeoff fuel injector must be cooled to preclude coking of the fuel in its fuel feed circuit.

It is known to fit a high power or takeoff fuel injector with a cooling system wherein the fuel feeding the low power fuel injector is made to circulate through the high power fuel injector. However, the known systems are complex insofar at they entail two fuel supplies and three fuel circulating tubes, a first tube wherein the fuel to the low power injector circulates centripetally and extending as far as the end of the high power fuel injector, a second tube coaxial with the first tube and connecting the high power fuel injector end to the low power fuel injector, the fuel feeding the low power injector circulating centrifugally in the second tube, and a third tube midway between the first and second tubes wherein the fuel feeding the high power fuel injector circulates centripetally. In such systems, external complimentary means must be provided to distribute the fuel between the two circuits depending upon the operation mode of the turbojet engine.

French Patent No. 2,441,725 discloses a dual head combustion chamber having a single fuel feed wherein each bypass conduit is directly connected to the low power fuel injector nozzle such that part of the fuel is bypassed towards the high power fuel injector nozzle by a check valve controlled by a regulator in the injector head which is, in turn, controlled by an external drive means. In this system, the relatively cool fuel cools the valve rod in the immediately adjacent vicinity, but does not permit the cooling of the high power fuel injector all the way to its distal end.

SUMMARY OF THE INVENTION

The present invention relates to a method and apparatus for supplying fuel to and cooling a fuel injector of a gas turbine engine having a dual head combustion chamber. The method comprises the steps of supplying a total fuel flow to the fuel injector such that at least a portion of the total fuel flow circulates through the high power injector nozzle during all operational modes of the gas turbine engine, including those modes in which the high power injector is not supplying fuel to the combustion chamber, and evacuating unused fuel from the high power injector. In a first embodiment, the fuel evacuated from the high power injector nozzle is subsequently supplied to the low power injector nozzle. Alternatively, the evacuated unused fuel may be returned to the fuel supply reservoir.

The apparatus for supplying fuel to and cooling the fuel injector comprises a fuel injector assembly having a low power injector and a high power injector which has fuel injection orifices wherein the high power injector is operable only during selected operational modes of the gas turbine engine; a fuel supply conduit connected to the high power injector to supply at least a portion of the total fuel flow supplied to the fuel injector to the high power injector during all operational modes of the gas turbine engine; fuel control means to control the amount of fuel flowing through the fuel injector orifices; and a fuel evacuation conduit connected to the high power injector so as to evacuate unused fuel from the high power injector. A valve in the fuel supply conduit controls the amount of fuel flowing through the high power fuel injection orifices and may comprise a movable valve member located in the tip of the high power fuel injector so as to control the opening and closing of the fuel injection orifices.

When the fuel injection orifices are closed, no fuel is supplied to the combustion chamber and the total amount of fuel is evacuated and either supplied to the low power fuel injector, or returned to the fuel supply system. The circulation of the fuel through the high power fuel injector cools the injection nozzle and prevents coking of the fuel.

During high power engine operating modes, the valve member is moved by the increased fuel pressure to a position wherein the fuel injection orifices are opened, thereby allowing fuel to be supplied to the combustion chamber through the high power fuel injector. During this operational mode, a portion of the fuel supplied to the high power fuel injector is evacuated from the high power fuel injector and either supplied to the low power fuel injector, or returned to the fuel supply.

Preferably, all of the fuel flow feeding the dual headed injector is made to circulate through the high power fuel injector regardless of the operating mode of the gas turbine engine and thereupon the fuel flow is moved toward the low power fuel injector when the gas turbine engine is operating at less than the minimum operating mode for operation of the high power fuel injector. When the gas turbine engine is operating above the minimum operating mode for the high power fuel injector, the fuel flow is split between the low power fuel injector and the high power fuel injector.

DETAILED DESCRIPTION OF THE PREFERRED EMBODIMENTS

Figure 1:
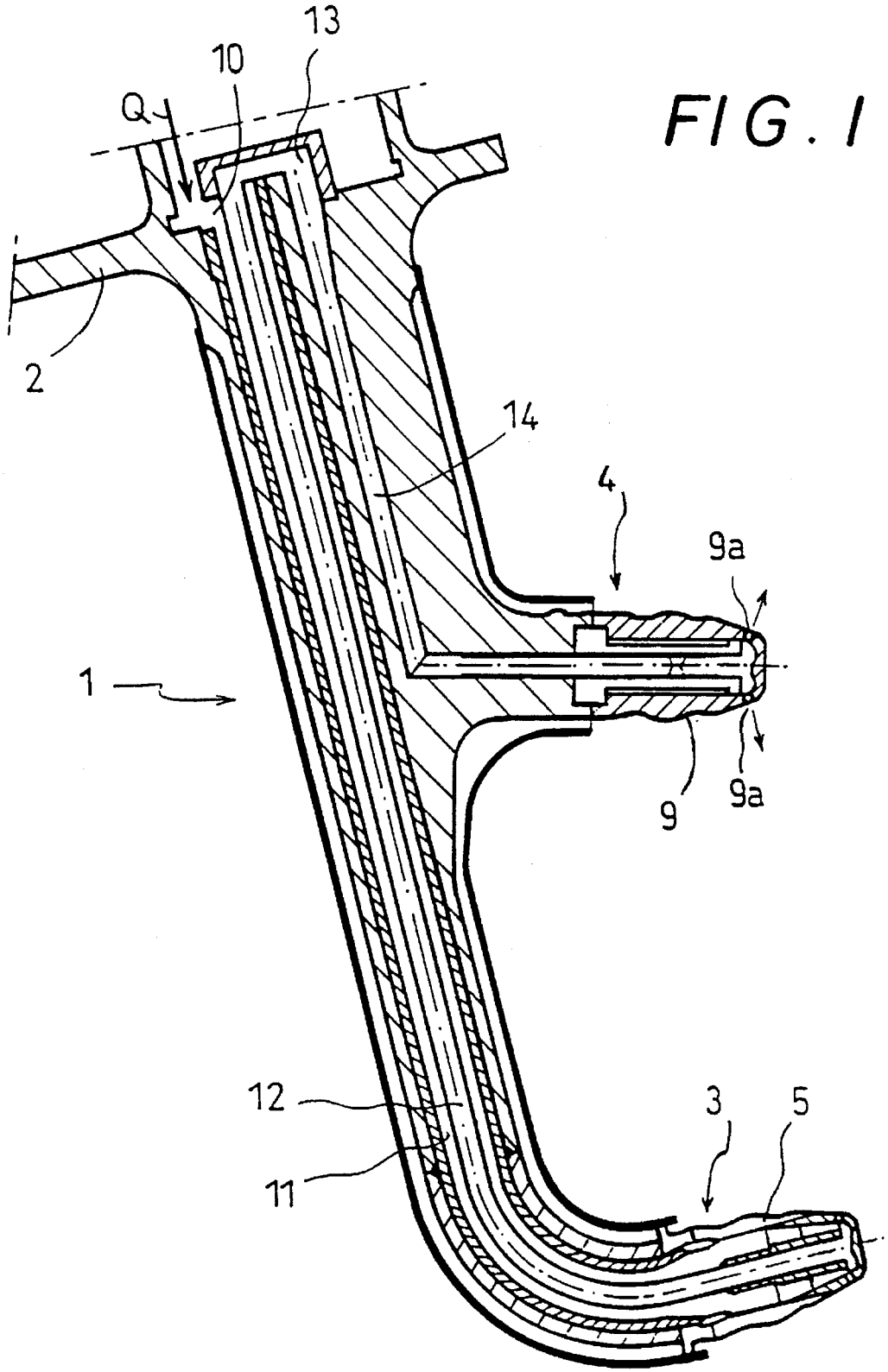
FIG. 1 is a cross-sectional view of the dual fuel injector utilized in gas turbine engines having dual head combustion chambers according to the present invention.

FIG. 1 illustrates a double fuel injector assembly 1 feeding a dual head, annular combustion chamber of a gas turbine engine (not shown) and comprises a head portion 2 used to affix the fuel injector assembly 1 to the gas turbine engine casing, a high power fuel injector 3 and a low power fuel injector 4 located approximately midway between the head portion 2 and the high power fuel injector 3. The high power fuel injector 3 is fitted with a high power fuel injector nozzle 5 enclosing an inner chamber 6 and having a peripheral wall 7 defining an annular row of fuel injection orifices 8. The low power fuel injector 4 also comprises at its end a low power fuel injector nozzle 9 having a plurality of fuel injector orifices 9*a*.

In the head portion 2, the intake zone 10 allows the total fuel flow Q to feed the high power injector 3 and the low power injector 4. A first conduit 11 connects the intake zone 10 to the chamber 6 in the high power fuel injector nozzle 5. A second conduit 12, located coaxially within the first conduit 11 communicates between the chamber 6 and a second chamber 13 located in the head portion 2, which in turn, communicates via a third conduit 14 with the fuel injection orifices 9*a* of the low power fuel injector nozzle 9.

An end 15 of the second conduit 12 is located within the chamber 6 of the high power fuel injector nozzle 5 and holds an annular valve member 16 of which the radial wall 17 seals the outlet of the first conduit 11. Valve member 16 is mounted in a sliding manner on the end 15 and is connected by a spring 18 to an inner wall of the second conduit 12.

Figure 3:
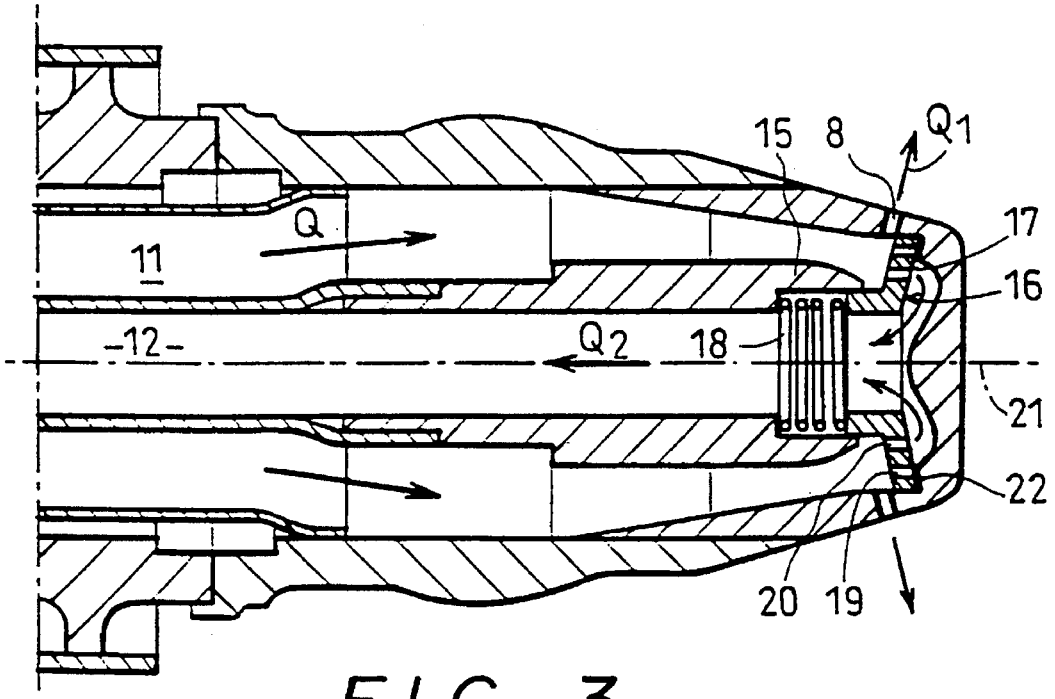
FIG. 3 is a view similar to FIG. 2 illustrating the fuel control valve in a second, high power position.
Figure 4:
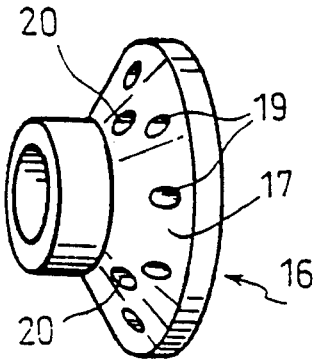
FIG. 4 is a perspective view of the fuel control valve member utilized in the embodiments set forth in FIGS. 1–3.

The radial wall 17 defines a first set of axial orifices 19 and a second set of axial orifices 20. As best illustrated in FIGS. 3 and 4, the orifices 19 and 20 are circumferentially distributed about an axis 21 of the high power fuel injector nozzle 5 with the orifices 19 being located further away from the axis 21 than the orifices 20.

Figure 2:
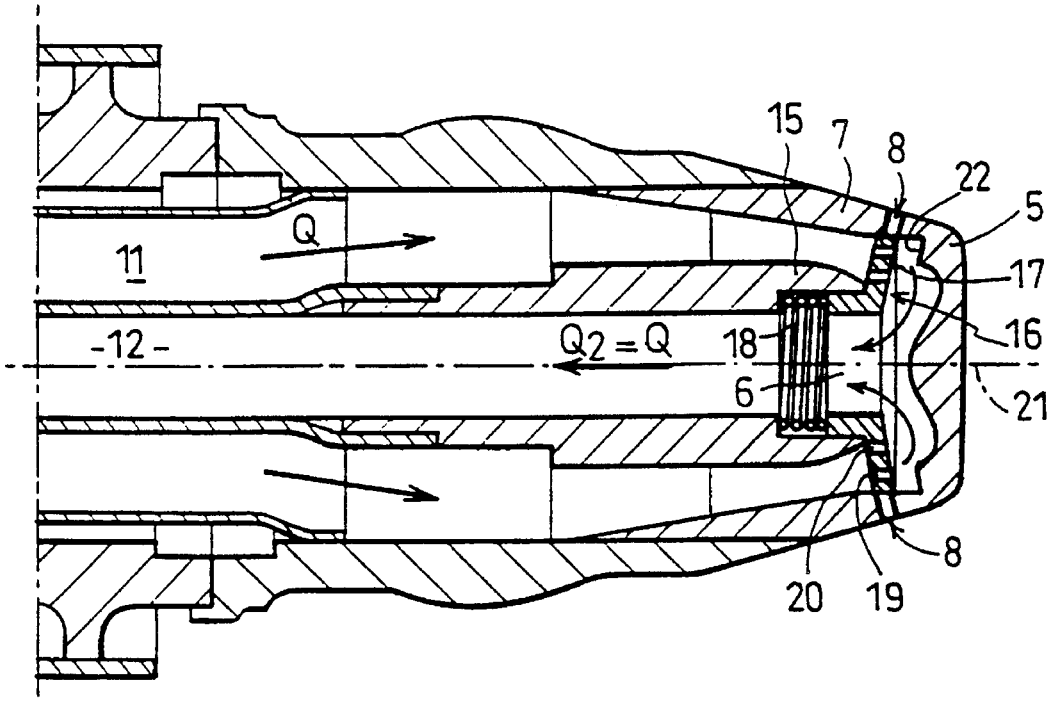
FIG. 2 is an enlarged, cross-sectional view of the distal end of the high power fuel injector with the flow control valve in a first, low power position.

In the absence of fuel flow in the first conduit 11, spring 18 urges the valve member 16 to the position illustrated in FIG. 2 in which the radial wall 17 contacts the end 15 of the second conduit 12. In this position, called the low power position, the peripheral surface of the radial wall 17 seals the fuel injection orifices 8 of the take-off nozzle 5, thus preventing any fuel flow through the fuel injector orifices 8. The force of the spring 18 is designed such that the valve member 16 will remain in the low power position as long as the total fuel flow Q is less than flow $Q_0$ which corresponds to the minimum operational mode that would use the high power fuel injector of the dual head combustion chamber.

At low power, all of the fuel flow Q fed through the intake zone 10 circulates in the first conduit 11, passes through the axial orifices 19 and 20 of the valve member 16, enters the chamber 6 of the high power fuel injector nozzle 5 and is thereupon fed to the low power fuel injector 4 via second conduit 12, second chamber 13 and third conduit 14. Accordingly, under low power operating conditions of the gas turbine engine, all of the fuel flow Q circulates through the inner chamber 6 of the high power fuel injector 3 to substantially cool the fuel injector 3. The fresh fuel circulating through the conduits 12 and 13 precludes coking of the high power fuel injector 3.

Figure 5:
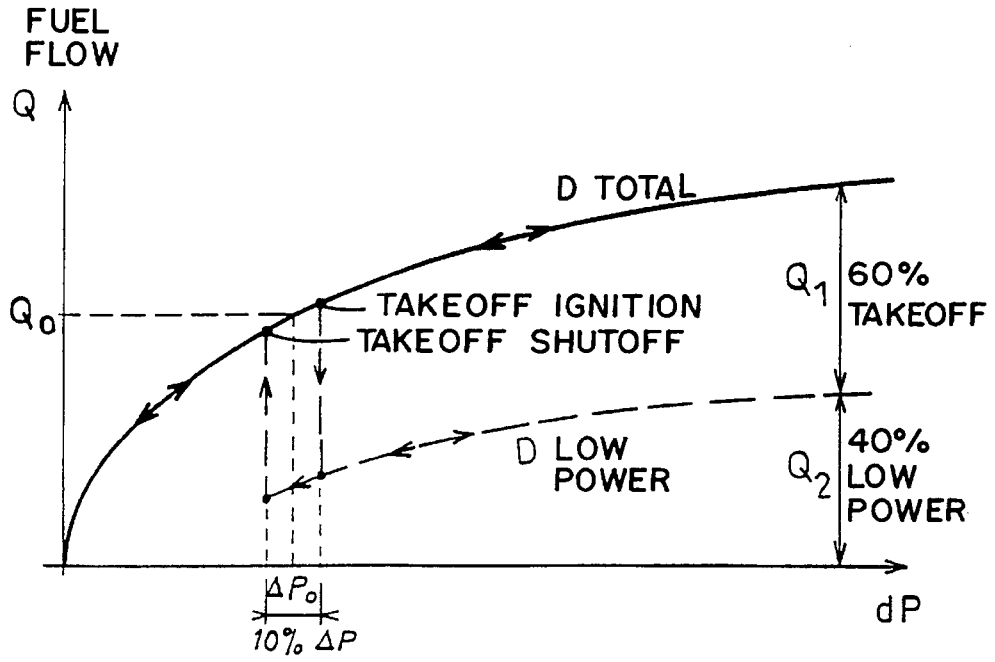
FIG. 5 is a graph of the fuel flow versus change in fuel pressure for the fuel flow feeding the dual injector according to the present invention.
Figure 6:
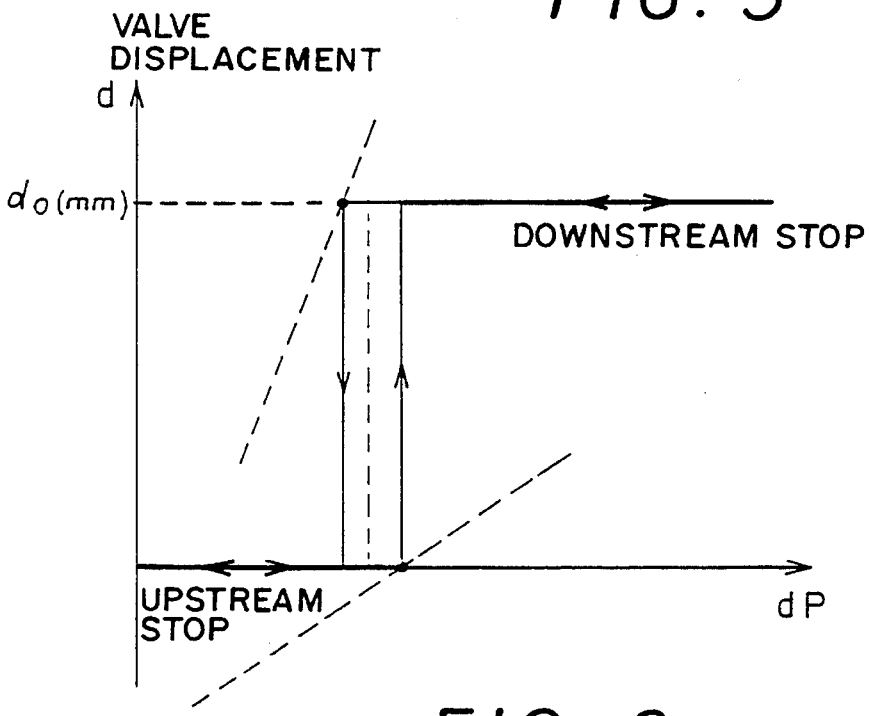
FIG. 6 is a graph of fuel control valve displacement versus change in fuel pressure acting on the valve.

Orifices 19 and 20 of the valve member 16 create a pressure differential dP across the two sides of the radial wall 17 which is related to the total fuel flow Q as illustrated in FIG. 5. When the total fuel flow Q is higher than flow $Q_0$, corresponding to the minimum operational mode which makes use of the high power fuel injector head, the pressure differential dP acts on the valve member 16 against the force of spring 18 and displaces the valve member 16 downstream by a distance $d_0$. In this position, called the high power or takeoff position, illustrated in FIG. 3, the valve member 16 rests against an annular stop 22 formed on the high power fuel injector nozzle 5. The stop 22 is located such that it is opposite the first fuel orifices 19 so as to prevent any flow through these orifices in the position. In the high power position, the radial wall 17 is clear of the fuel injection orifices 8 to allow a fuel flow portion $Q_1$ to flow through these orifices. A second portion of fuel $Q_2$ flows through the second axial orifices 20 of the valve member 16 and passes through the second conduit 12, the second chamber 13 and the third conduit 14 to the low power fuel injector 4.

FIG. 5 illustrates the splitting of the fuel flow between the high power injector 3 and the low power injector 4 beyond the minimum flow $Q_0$ in relation to the fuel feed pressure. As the operational mode of the gas turbine engine moves toward the higher power mode, the valve member 16 shifts downstream when the flow Q is slightly higher than the minimum fuel flow $Q_0$ and vice versa when the operational mode moves towards the lower power, the valve member 16 shifts upstream when the flow Q is slightly less than the switchover fuel flow $Q_0$. When the valve 16 is in its limit positions, the radial wall 17 rests against the front surface of the second conduit 12, in the low power mode, and rests against the annular stop 22 in the high power mode. This prevents hunting by the valve member 16 in the vicinity of the switchover mode corresponding to the minimum flow $Q_0$.

The maximum shift $d_0$ of the valve member 16 may be slight. For a displacement do=1 mm, a fuel I split of 40% to the low power fuel injector head and a switchover fuel flow of 37 kg/h, the number N and diameter D of the orifices 8, 9*a*, 19 and 20 of the high power injector 3 may be as follows:

injection orifices 8 of the high power nozzle 5, N=6, D=0.5 mm;

orifices 19 of valve member 16, N=10, D=0.6 mm;

orifices 9*a* of low power fuel injector nozzle 9, N=12, D=0.5 mm.

Figure 7:
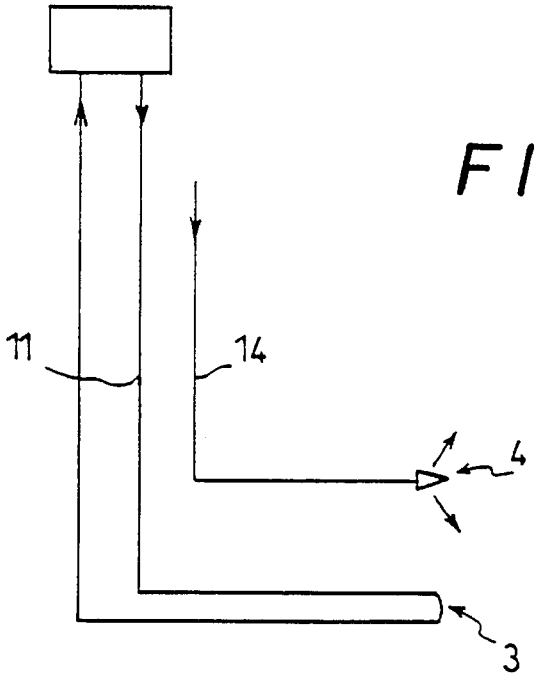
FIG. 7 is a schematic diagram of a fuel circuit according to a second embodiment of the present invention.
Figure 8:
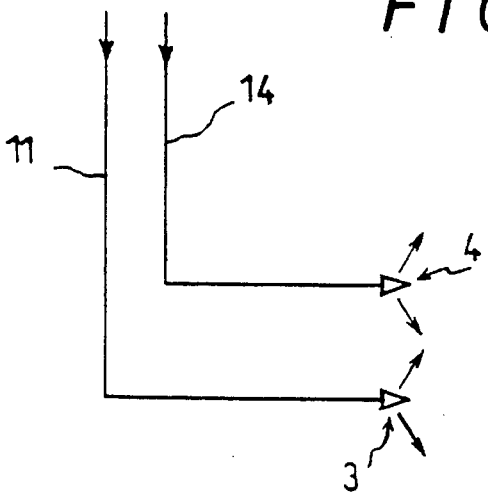
FIG. 8 is a schematic diagram of the fuel circulation in the high power operating mode for the embodiment illustrated in FIG. 7.
Figure 9:
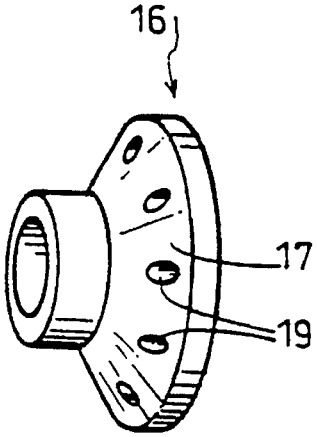
FIG. 9 is a perspective view of the fuel control valve member utilized in the embodiment of FIGS. 7 and 8.

In the above described, preferred embodiment of the invention, the dual injector 1 comprises only one fuel feed in the zone 10. However, the two fuel injectors may be supplied separately by a direct fuel feed to the low power injector 4 and a separate, direct feed to the high power fuel injector 3 as illustrated in FIGS. 7–9. In this embodiment, the low power fuel injector 4 is supplied directly from an external fuel feed through the third conduit 14. The high power fuel injector 3 is supplied directly through the first conduit 11. In this embodiment, the valve member 16 has only a single set of orifices 19, as illustrated in FIG. 9, which are sealed by the annular shoulder 22 in the high power position of valve member 16. The second conduit 12 exhausts the fuel transmitting the inner chamber 6 of the high power fuel injector nozzle 5 during the low power operating mode so as to thereby cool the high power fuel injector 3.

The foregoing description is provided for illustrative purposes only and should not be construed as in any way limiting this invention, the scope of which is defined solely by the appended claims.

We claim:

1. A method for supplying fuel to and cooling a fuel injector assembly of a gas turbine engine wherein the fuel injector assembly has a low power injector and a high power injector with fuel injection orifices, the high power injector being operable only during selected operational modes of the gas turbine engine comprising the steps of: supplying a total fuel flow (Q) to the fuel injector assembly such that at least a portion of the total fuel flow circulates through the high power injector during all operational modes of the gas turbine engine; providing valve means in the high power injector to control the amount of fuel passing through the fuel injection orifices, the amount being variable between zero flow and a maximum flow; and, evacuating unused fuel from the high power injector.

2. The method of claim 1 wherein all of the total fuel flow circulates through the high power injector.

3. The method of claim 1 comprising the additional step of supplying the fuel evacuated from the high power injector to the low power injector.

4. Apparatus for supplying fuel to and cooling a fuel injector of a gas turbine engine comprising:

a) a fuel injector assembly with a low power injector and a high power injector having fuel injection orifices, the high power injector being operable only during selected operational modes of the gas turbine engine;

b) a fuel supply conduit connected to the high power injector to supply at least a portion of the total fuel flow supplied to the fuel injector assembly to the high power injector during all operational modes of the gas turbine engine;

c) fuel control means to control the amount of fuel flowing through the fuel injection orifices; wherein the fuel control means comprises:

i) a valve in the fuel supply conduit having a valve member movable between a low power position wherein fuel flow through the fuel injector orifices is prohibited and a high power position wherein fuel flow through the fuel injection orifices is at a maximum; and, ii) biasing means acting on the valve member so as to bias the valve member toward its low power position, whereby the valve member is moved toward the high power position when the fuel pressure in the fuel supply conduit reaches a predetermined threshold value; and d) a fuel evacuation conduit connected to the high power injector so as to evacuate unused fuel from the high power injector.

5. The apparatus of claim 4 further comprising a plurality of first fuel control orifices formed in the valve member.

6. The apparatus of claim 5 further comprising a shoulder on the high power fuel injector located such that the shoulder blocks the plurality of first fuel control orifices when the valve member is in the high power position.

7. The apparatus of claim 5 further comprising a plurality of second fuel control orifices formed in the valve member.

8. The apparatus of claim 4 wherein the fuel evacuation conduit is also connected to the low power injector so as to supply the fuel evacuated from the high power injector to the low power injector.

9. The apparatus of claim 4 wherein the fuel supply conduit and the fuel evacuation conduit are coaxial.

* * * * *